US007970317B2

(12) United States Patent
Seto

(10) Patent No.: US 7,970,317 B2
(45) Date of Patent: Jun. 28, 2011

(54) IMAGE FORMING APPARATUS

(75) Inventor: Masaki Seto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 11/953,658

(22) Filed: Dec. 10, 2007

(65) Prior Publication Data

US 2008/0159784 A1 Jul. 3, 2008

(30) Foreign Application Priority Data

Dec. 28, 2006 (JP) ..... 2006-354432

(51) Int. Cl.
*G03G 15/00* (2006.01)

(52) U.S. Cl. ..... 399/167; 399/38

(58) Field of Classification Search ..... 399/38, 399/159, 162, 167
See application file for complete search history.

(56) References Cited

U.S. PATENT DOCUMENTS

| | | | | |
|---|---|---|---|---|
| 5,394,222 | A * | 2/1995 | Genovese | 399/167 |
| 2004/0156654 | A1* | 8/2004 | Nishizaki | 399/167 |
| 2006/0088338 | A1* | 4/2006 | Matsuda et al. | 399/167 |

FOREIGN PATENT DOCUMENTS

| | | | |
|---|---|---|---|
| JP | 02-043574 | A | 2/1990 |
| JP | 05-252774 | A | 9/1993 |
| JP | 07-303385 | A | 11/1995 |
| JP | 10-066373 | A | 3/1998 |

* cited by examiner

*Primary Examiner* — David P Porta
*Assistant Examiner* — Benjamin Schmitt
(74) *Attorney, Agent, or Firm* — Canon U.S.A., Inc. I.P. Division

(57) ABSTRACT

An image forming apparatus includes a rotating member, a driving force transmission unit configured to transmit drive force to the rotating member, a drive unit configured to rotationally drive the rotating member via the driving force transmission unit, a detecting unit configured to detect a velocity of the rotating member and generate velocity data based in the detected velocity, and a control unit configured to control the drive unit based on the velocity data. The control unit calculates a correction value to be added to a drive velocity instruction value so as to cancel velocity variation of velocity data during one rotation of the rotating member, and a correction value is controlled so as to eliminate a difference between a correction drive instruction value obtained by adding a correction value to a drive velocity instruction value and the drive velocity instruction value.

11 Claims, 7 Drawing Sheets

VELOCITY DETECTION DATA

VELOCITY VARIATION DATA

VELOCITY VARIATION DATA AFTER FILTERING

PHASE INVERTED AND GAIN MULTIPLIED DATA

AVERAGE VELOCITY MODIFYING OPERATION

CORRECTION VELOCITY INSTRUCTION VALUE DATA (CORRECTION AND VELOCITY INSTRUCTION VALUE)

VELOCITY DETECTION DATA AFTER CORRECTION CONTROL

VELOCITY DETECTION DATA (BEFORE CONTROL)

CORRECTION VALUE

VELOCITY DETECTION DATA AFTER CONTROL

IMAGE FORMING APPARATUS

BACKGROUND OF THE INVENTION

1. Field of the Invention

The present invention relates to a control technique for correcting a velocity variation of a rotating member, such as a photosensitive drum or a drive roller that drives a photosensitive drum or a transfer belt, of an image forming apparatus, such as a printer, copier or multifunction peripheral.

2. Description of the Related Art

In an image forming apparatus such as a copying machine or a printer employing an electrophotographic process, it is known that, if a rotational variation (velocity variation) occurs to a rotating member (such as a photosensitive drum serving as a photosensitive member) in an image forming unit, a drive unit or a driving force transmission mechanism of the rotating member, an output image becomes uneven (i.e., image quality is degraded).

In addition, color image forming apparatuses may employ a plurality of image forming units to form a toner image with various colors. Generally, the plurality of image forming units is arranged in a moving direction of a transfer material transport belt onto which the toner image is transferred from the photosensitive drum, or in a direction of an intermediate transfer belt onto which the toner image is primarily transferred.

In the following description, the transfer material transport belt and the intermediate transfer belt are collectively referred to "transfer belt".

In the image forming apparatus of this type, a rotational variation may occur due to a mechanical misalignment such as eccentricity of a drive gear (driving force transmission mechanism) of the photosensitive drum and eccentricity of a drive motor shaft (drive unit) in the image forming unit. As a result, registrations in a sub-scanning direction of the toner images formed on the photosensitive drums may not be aligned on a transfer material onto which multiple images are finally transferred. Similarly, the registrations in the sub-scanning direction of the toner images may not be aligned due to a rotational variation caused by eccentricity of a drive gear of a transfer belt and eccentricity of a drive motor shaft (drive unit). (Hereinafter, the above phenomenon is referred to as color misregistration.) Accordingly, there is a problem that unevenness of the image or color misregistration may appear in the sub-scanning direction due to eccentricity or the like caused by a mechanical misalignment which can be generated during a process of manufacturing and assembling drive-system parts of the photosensitive drum or transfer belt. In particular, the eccentricity that appears in a reduction gear portion for driving force transmission or meshing pitch unevenness between gears, leads to a periodic angular velocity variation of the rotating member.

Therefore, in order to solve the problem, Japanese Patent Application Laid-open No. 2-43574 discusses a method in which a rotational motion of a rotating member is grasped by detecting an angular velocity using an equipment such as an encoder mounted on a shaft of the rotating member or alternatively, by detecting a surface velocity of a transfer belt. Thus, the periodic velocity variation caused by the eccentricity of the gear is detected and the drive can be corrected in accordance with a velocity instruction for eliminating the periodic velocity variation. Consequently, a velocity variation is canceled and a stable rotational motion of the rotating member can be obtained.

In Japanese Patent Application Laid-open No. 2-43574, it discusses a need to improve resolution with which a detecting unit performs detection in a comparatively high frequency band such as meshing pitch unevenness of gears. Japanese Patent Application Laid-open No. 2-43574 attempts to achieve highly precise drive control by improving resolution of a detection device.

However, in the configuration as described above, there is a problem that a drive unit has to minutely change velocity by performing correction control, and a drive torque associated with correction changes significantly when velocity is changed. Therefore, the drive motor can step out in a drive system employing a pulse motor. Even if no stepping out occurs, since the drive motor uses a wide frequency band, vibration can be applied and added to a resonance frequency in the driving force transmission unit or a machine which can induce a resonance phenomenon in a drive and mechanical system.

Therefore, in order to solve the problem described above, employing of a moving average process in response to detected rotational velocity information is discussed in Japanese Patent Application Laid-open No. 5-252774, Japanese Patent Application Laid-open Nos. 7-303385 and 10-066373. However, in the case where the moving average process is performed, a calculation error may occur due to the rounding-down or rounding-up of fractions in the calculation process. Namely, in the moving average process, since the moving average process is applied to a plurality of divided intervals in one revolution (one rotation of the rotating member), calculation errors can accumulate at each interval. Thus, an instruction of average velocity actually given to a drive system when the rotating member makes one revolution may be shifted by accumulated errors from a desired average velocity. In addition, the average velocity may also be shifted in a case where a phase of a rotational variation period of the drive unit or driving force transmission unit at the upstream of a photosensitive drum or a transfer belt, does not match one rotation of a rotational variation period of a roller for driving the photosensitive drum or the transfer belt. If this shift of the average velocity adversely affects drive of the photosensitive drum or transfer belt, an image magnification varies in a sub-scanning direction, which causes color misregistration in the sub-scanning direction in the case of a multi-transferring device.

Further, as illustrated in FIG. 7A, average moving values are calculated at each interval (at each dotted interval on "t" axis in the figure), and as illustrated in FIG. 7B, control is performed to give a predetermined correction velocity instruction (correction value) to the intervals. As a result, a control residual error occurs as illustrated in FIG. 7C. Rotational variation due to this control residual error appears as image unevenness.

In addition, similar to the average moving process for calculating the average moving value, there is a case in which filter calculation is performed in a unit that prevents a resonance phenomenon. However, also in this case, similar to the moving average process, an actual detection velocity has a variety of frequency bands even if a cut off frequency is strictly restricted when performing filter calculation. Accordingly, a difference may occur between a desired average velocity and an average velocity instruction obtained with a correction output value after filter calculation in one revolution of a rotating member. In other words, the velocity profile after filter calculation is shifted from a target average velocity, which causes image defect such as color misregistration or magnification variation similar to the above described methods.

SUMMARY OF THE INVENTION

An embodiment of the present invention is directed to an image forming apparatus capable of producing a good quality output image with appropriate print precision, without color misregistration in a sub-scanning direction or image unevenness since a velocity variation is reduced and an average velocity in one revolution of a rotating member is constant with respect to an instruction value in which correction is added to a drive.

According to an aspect of the present invention, an embodiment is directed to an image forming apparatus including a rotating member, a driving force transmission unit (e.g., motor) configured to transmit drive force to the rotating member, a drive unit configured to rotationally drive the rotating member via the driving force transmission unit, a detecting unit configured to detect a velocity of the rotating member and generate velocity data based on the detected velocity, and a control unit configured to control the drive unit based on the velocity data, wherein the control unit calculates a correction value to be added to velocity variation to a drive velocity instruction value so as to cancel velocity variation of velocity data during one rotation of the rotating member, and a correction value is controlled so as to eliminate a difference between a correction drive instruction value obtained by adding a correction value to a drive velocity instruction value and the drive velocity instruction value.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute apart of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
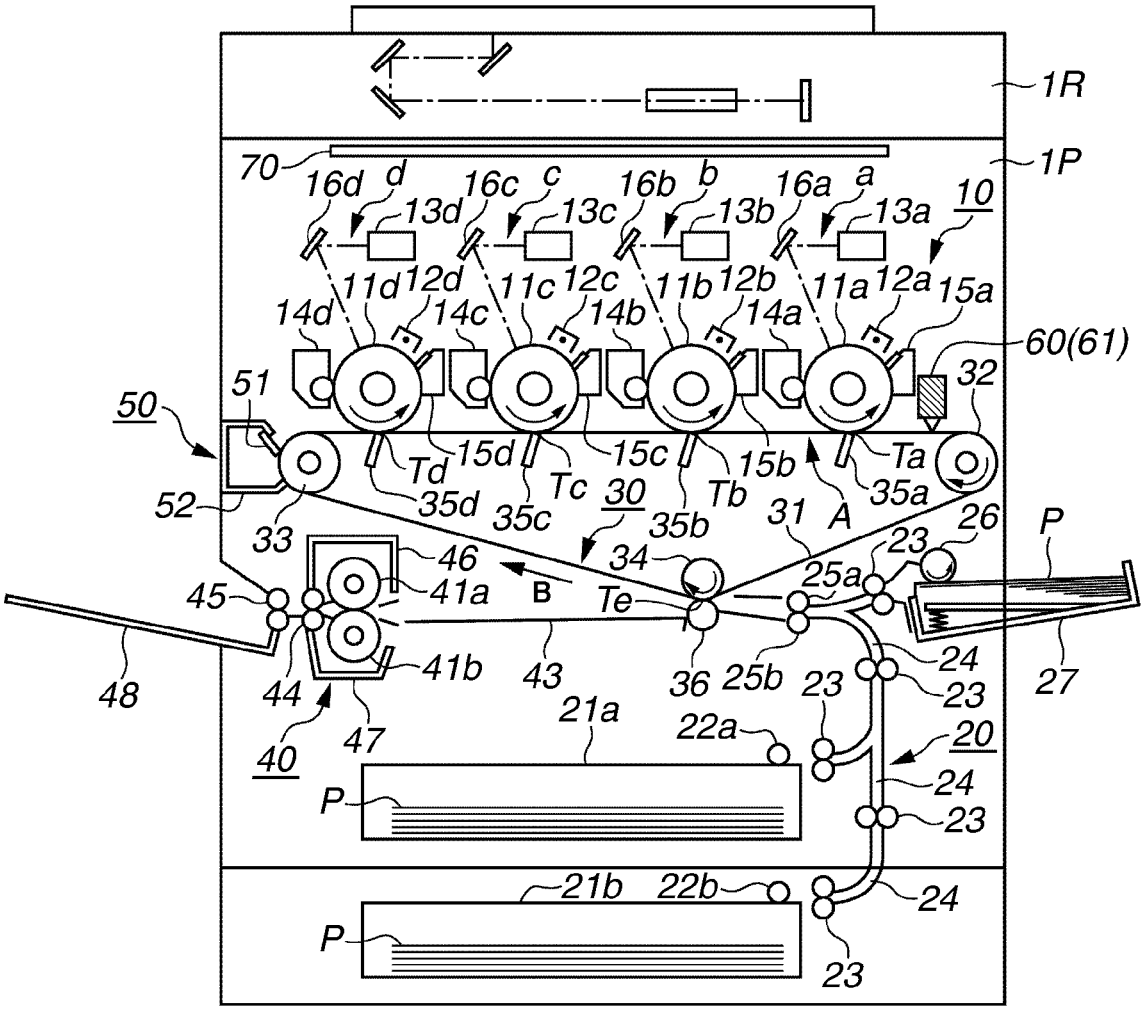
FIG. 1 is a view illustrating a configuration of an image forming apparatus according to an embodiment of the present invention.

FIG. 1 is a longitudinal cross section illustrating a configuration of an image forming apparatus according to an exemplary embodiment of the present invention. The illustrated image forming apparatus includes a printer unit 1P serving as an image forming unit and a reader unit 1R serving as an image reading unit.

The printer unit 1P is a full-color laser beam printer employing an intermediate transfer method. The printer unit 1P includes an image forming unit 10 having four identically configured image forming stations "a", "b", "c", "d", a feeding unit 20, an intermediate transfer unit 30, a fixing unit 40, a cleaning unit 50 and a control unit (not illustrated).

The image forming unit 10 is configured as described below. Drum type photosensitive members 11*a*, 11*b*, 11*c*, 11*d* (hereinafter, referred to as "photosensitive drums"), which serve as image carriers, are pivoted at its center, and is rotationally driven in a direction indicated by an arrow. Primary charging devices 12*a*, 12*b*, 12*c*, 12*d*; optical systems 13*a*, 13*b*, 13*c*, 13*d*; folding mirrors 16*a*, 16*b*, 16*c*, 16*d;* development devices 14*a*, 14*b*, 14*c*, 14*d*; and cleaners 15*a*, 15*b,* 15*c*, 15*d* are disposed opposing the outer periphery of the photosensitive drums 11*a* to 11*d*.

The surfaces of the photosensitive drums 11*a* to 11*d* are uniformly charged with a predetermined polarity and at a predetermined electric potential by the primary charging devices 12*a* to 12*d*. After charging is performed onto the surfaces of the photosensitive drums, light beams such as laser beams modulated according to a recording image signal are radiated via the folding mirrors 16*a* to 16*d* so that an electrostatic latent image is formed. Further, in the development devices 14*a* to 14*d* that contains toner (developing agent) of four colors, yellow, cyan, magenta and black, the toner is attached to the electrostatic latent image as described above and an image of the toner is developed. The areas where this toner image is transferred to an intermediate transfer belt (endless belt) 31 are defined as primary transfer areas Ta, Tb, Tc, Td. The toner (transfer residual toner) which has not been transferred to the intermediate transfer belt 31 is scraped by the cleaning devices 15*a*, 15*b*, 15*c*, 15*d* and the drum surfaces are cleaned. The cleaning devices 15*a*, 15*b*, 15*c*, 15*d* are arranged at the downstream side of the image transfer areas Ta to Td in a rotational direction of the photosensitive drums 11*a* to 11*d*. In each image forming process as described above, images are formed sequentially by each color toner. Among the primary transfer areas Ta to Td, in particular, the primary transfer area Ta disposed at the most downstream side in an advancing direction (moving direction) of the intermediate transfer belt 31 is referred to as a most downstream transfer area.

The feeding unit 20 includes feeding cassettes 21*a* and 21*b* for storing transfer materials P and a manual feed tray 27. The transfer materials P are fed one by one from the feeding cassettes 21*a* and 21*b* and the manual tray 27. Further, the feeding unit 20 includes pickup rollers 22*a*, 22*b*, 26 for feeding the transfer materials P and transfers the fed transfer materials P to registration rollers 25*a* and 25*b*. In addition, the feeding unit 20 includes a feeding roller pair 23, a feeding guide 24 and registration rollers 25*a* and 25*b* for feeding the transfer materials P to a secondary transfer area Te in synchronization with the image forming units a, b, c, d.

The intermediate transfer unit 30 includes a belt-shaped intermediate transfer belt 31 that serves as an intermediate transfer member. The intermediate transfer belt 31 is wound around three rollers 33, 32 and 34. The drive roller 33 transmits drive force to the intermediate transfer belt 31. The driven roller 32 is rotated following rotation of the intermediate transfer belt 31. The secondary transfer opposite roller 34 opposes a secondary transfer area Te while the intermediate transfer belt 31 is sandwiched therebetween and wound around the opposite roller 34. Among these rollers, a primary transfer plane A is formed between the drive roller 33 and the follower roller 32. The drive roller 33 prevents slipping over a belt by coating a rubber (urethane or chloroprene) of thickness of several millimeters on the surface of the metal roller. The drive roller 33 is rotationally driven by a drive motor described above. In the present embodiment, time required for performing one revolution of the drive roller 33 is set to be shorter than that required for performing one drive of each photosensitive drum. In the primary transfer areas Ta to Td where the photosensitive drums 11*a* to 11*d* and the intermediate transfer belt 31 are opposed to each other, primary charging devices 35*a*, 35*b*, 35*c*, 35*d* are disposed on the back (inner periphery face) of the intermediate transfer belt 31. A secondary transfer roller 36 is disposed so that it is opposed to the secondary transfer opposite roller 34. The secondary transfer roller 36 forms a secondary transfer area Te in a nip with the intermediate transfer belt 31. The secondary transfer roller 36 is pressurized under a proper pressure to the intermediate transfer belt 31. Further, the cleaning device 50 for cleaning an image forming face of the intermediate transfer belt 31 is arranged at the downstream of the secondary transfer area Te in the moving direction (direction indicated by the arrow B) of the intermediate transfer belt 31. The cleaning device 50 includes a cleaning blade 51 for removing a transfer residual toner adhering to the image forming face, and a waste toner box 52 for receiving the removed transfer residual toner as a waste toner.

The fixing unit 40 includes a fixing roller 46 including a heat source 41a such as a halogen heater, a pressurizing roller 47 including a heat source 41*b*, the roller being abutted against the fixing roller 46 and a guide 43 for guiding a transfer material P to a nip portion between the fixing roller 46 and the pressurizing roller 47. The fixing unit 46 also includes an internal discharge roller 44 for discharging the transfer material P that has been discharged from the nip portion further to the outside of a main body of the image forming apparatus, an external discharge roller 45 and an discharge tray 48 for receiving the discharged transfer material P.

The control unit includes a board such as a control board 70 for controlling an operation of a mechanism in each of the units described above or a motor drive board (not illustrated).

Next, an operation of the image forming apparatus configured as described above will be described.

When an image forming operation start signal is issued, a pickup roller 22*a* feeds the transfer materials one by one from the feeding cassette 21*a*. Then, the transfer materials P are guided through feeding guides 24 by a feeding roller pair 23 and are transferred to resist rollers 25*a* and 25*b*. At this time, the resist rollers 25*a* and 25*b* are inactivated and a tip end of the transfer material P abuts against the nip portion. After that, the resist rollers 25*a* and 25*b* start rotating in synchronization with the timing that an image forming station starts image forming. The rotation timing of the resist rollers 25*a* and 25*b* is set so that the transfer materials P and the toner image that is primarily transferred from the image forming station onto the immediate transfer belt 31, are coincident with each other in the secondary transfer area Te.

On the other hand, when the image forming start signal is issued, the image forming station starts the following operation performing the image forming process described previously. The toner image formed on a photosensitive drum lid in an image forming station d that is disposed at the most upstream in the rotational direction of the intermediate transfer belt 31, is primarily transferred to the intermediate transfer belt 31 in a primary transfer area Td by a primary transfer charging device 35*d*. High voltage is applied to the transfer charging device 35*d*. The primarily transferred toner image is transported to a next primary transfer area Tc. In the transfer area Tc, an image is formed with a delay of time during which the toner image is transported between the image forming units. A next toner image is transferred onto the intermediate transfer belt 31 while registration is aligned on the preceding toner image. Hereinafter, similar processes are repeated and finally, the toner image of each four color is primarily transferred onto the intermediate transfer belt 31 and is superimposed thereon.

After that, the transfer material P enters the secondary transfer area Te in the direction indicated by the arrow B in accordance with rotation of the intermediate transfer belt 31 and contacts the intermediate transfer belt 31. Then, at the timing that the transfer material P passes the secondary transfer area Te, high voltage is applied to a secondary transfer roller 36 and the four-color toner image formed on the intermediate transfer belt 31 is secondarily transferred collectively to the surface of the transfer material P according to the above-described process. Thereafter, the transfer material P is guided precisely to the nip portion between a fixing roller 46 and a pressure roller 47 by a transport guide 43. The toner image is then fixed onto the surface of the transfer material P with heat and pressure by the fixing roller 46 and the pressure roller 47. Then, the transfer material P is discharged by an internal discharge roller 44 and an external discharge roller 45 to a discharge tray 48.

Figure 2:
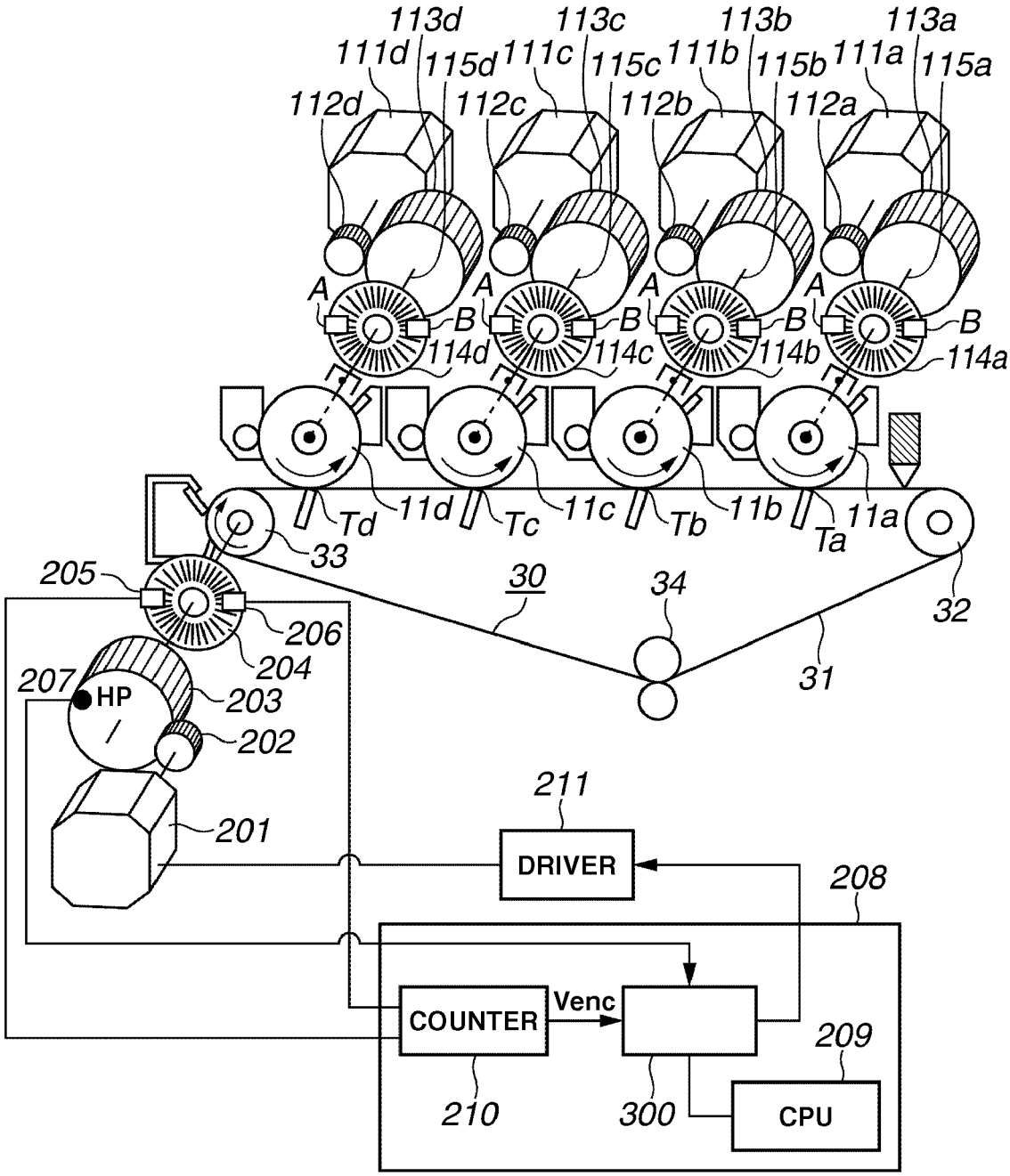
FIG. 2 is a view illustrating a configuration of a drive system according to an embodiment of the present invention.

FIG. 2 is a view illustrating a configuration of a drive system of photosensitive drums 11*a* to 11*d* and an intermediate transfer belt 31.

With respect to the drive system of the photosensitive drums 11*la* to 11*d*, image forming stations a, b, c, d have all similar configurations. Accordingly, a drive system of a photosensitive drum at the station "a" of black (Bk) will be described as an example. Reference symbol "a" denotes black (Bk); reference symbol "b" denotes cyan (C), reference symbol "c" denotes magenta (M), and reference symbol "d" denotes yellow (Y).

A drive motor 111*a* rotates a photosensitive drum shaft 115*a*. Rotational speed of the drive motor 111*a* driving a photosensitive drum is reduced by a motor gear 112*a* mounted on a rotary shaft of the drive motor 111*a* and a drum gear 113*a* mounted on a drum shaft. A photosensitive drum 11*a* and an encoder 114*a* for detecting a rotational velocity of the photosensitive drum shaft 115*a* are placed on the photosensitive drum shaft 115*a*.

The encoder 114*a* enables detecting of the rotational velocity variation that occurs on the photosensitive drum shaft 115*a*. The rotational velocity variation detected here is caused by rotational fluctuation of the rotary shaft of the drive motor 111*a*, fluctuation of the drum gear 113*a* and gear-mesh error.

Next, a configuration of a drive system of an intermediate transfer belt 31 will be described. Rotational speed of a drive motor 201 of the intermediate transfer belt 31 is reduced by a motor gear 202 of the drive motor 201 and a transfer belt drive gear 203, thus, a transfer belt drive roller 33 is rotated. An encoder 204 for detecting a rotational velocity is mounted on the shaft of the transfer belt drive roller 33. The encoder 204 enables detecting of the rotational velocity variation that occurs on the shaft of the transfer belt drive roller 33. The rotational velocity variation detected here is caused by rotational fluctuation of the drive motor shaft, transfer belt gear fluctuation and gear-mesh error similar to the encoder on the photosensitive drum shaft. In the present embodiment, stepping motors (pulse motors) are used as the drive motors 111, 201. However, drive motors according to the present invention is not limited to the stepping motors.

More specifically, a drive motor (stepping motor) 201 is driven according to a frequency F_stm (Pulse Per Second: hereinafter, referred to as "pps") of a drive signal output to the drive motor 201 (hereinafter, referred to as a drive pulse).

With respect to the drive motor 201, a rotational angle θ0 [rad] per pulse is specified in drive pulse. Pulse count M_stm (arbitrary positive integer) required for one revolution by the drive motor 201 is given by a formula (1) below.

$$M_stm=2\pi/\theta 0 \quad (1)$$

Therefore, rotational velocity V_stm (revolution per minutes: hereinafter, referred to as "rpm") of the drive motor 201 is given by a formula (2) below.

$$V_stm=(F_stm/M_stm)\times 60 \text{ [Second]} \quad (2)$$

For example, in a case of a two-phase stepping motor, the rotational angle θ0 per pulse=0.01π [rad] is obtained. Accordingly, pulse count M_stm required for one revolution is 200 pulses. If a drive frequency F_stm=3000 [pps], rotational velocity V_stm=900 [rpm] is established.

Accordingly, in a case where a drive gear 202 is driven by a drive motor 201 to rotate a drive roller 33, a rotational angle velocity (=rotational frequency) V_rot [rpm] of the drive roller 33 is given by a formula (3) below.

$$V_rot=V_stm/(N_\text{gear}/N_\text{shaft})=V_stm/R_\text{gear} \quad (3)$$

where R_gear is a gear ratio (reduction ratio: arbitrary positive integer) between a drive gear 203 and the gear 202 formed on an output shaft of the drive motor 201. In the example described above, assuming that gear ratio=10, the rotational angle velocity of the drive roller 33=900/10=90 [rpm] is established.

Encoders 205 and 206 are concentrically mounted on an end of a drive shaft of the drive roller 33. The encoders 205 and 206 output an encoder signal synchronized with a slit pattern input interval of a code wheel 204 that has a predetermined number N_wheel of slit patterns of a pre-designed predetermined width L_wheel [m]. In addition, the encoder 205 defined as an encoder A and the encoder 206 defined as an encoder B are set to a phase opposite to each other. The reason why such setting is made is that, in general, a rotational velocity of the drive roller 33 cancels influence of velocity variation caused by an eccentricity component of the drive roller 33 itself and an eccentricity component of the code wheel 204. Namely, an angular velocity of the drive roller 33 is often defined as a reference and, also in the present embodiment, an angular velocity variation of the drive roller 33 is detected based on a formula (4) below. Here, it is assumed that velocity data V_encA is detected by a signal from an encoder A205 and velocity data V_encB is detected by a signal from an encoder B206 and an angular velocity ω_R of the drive roller 33 is given by a formula (4) below.

$$\omega_R=(V_encA+V_encB)/2 \quad (4)$$

A home position sensor 207 detects a reference phase of the drive roller 33. A control unit 208 includes a CPU 209 that controls the entire drive mechanism and causes a correction value generating unit 300 to perform velocity correction control calculation as described below. A counter 210 counts a slit pattern input interval of the code wheel 204 using an output signal of an encoder A 205 and an encoder B 206 based on a reference clock C0 [Hz] (period of one clock=1/C0 [sec]). A correction value generating unit 3003 outputs to a motor driver 211 a drive pulse for driving the stepping motor 201.

Photosensitive drums 11*a* to 11*d* (i.e., rotating members) have a configuration similar to that of the control unit 208 although not illustrated in the drawing.

Next, a correction value generating unit 300 in the drive system will be described. The correction value generating unit 300 is formed similarly in both a photosensitive drum drive system and a transfer belt drive system. As an example, the transfer belt drive system will be described.

Figure 3:
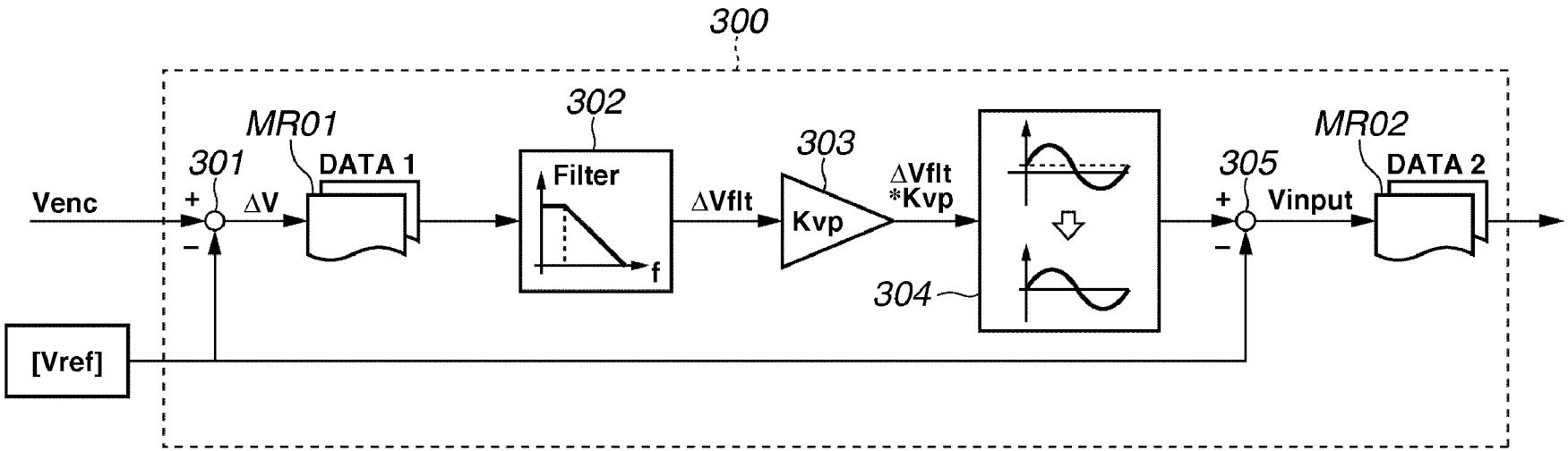
FIG. 3 is a view illustrating a configuration of a velocity variation correction value generation unit according to an embodiment of the present invention.

FIG. 3 schematically illustrates a correction value generating unit 300 that processes an input signal into a drive motor. FIGS. 4A to 4G are graphs illustrating patterns of velocity data or correction value data obtained in each of the correction value generating units 300. FIG. 5 illustrates an operational flow in relation to a generation of a correction value.

The correction value generating unit 300 includes a velocity variation extraction calculating unit 301, a filter calculating unit 302, a cancellation gain adjusting unit 303, an average velocity modifying unit 304 and a correction velocity instruction value generating unit 305. In addition, the correction value generating unit 300 includes a memory MR01 for accumulating velocity variation data for one revolution of a rotating member and a memory MR02 for accumulating a correction velocity instruction value for one revolution of a rotating member.

A CPU 209 of the control unit 208 executes the process illustrated in FIG. 5 by employing a random access memory (RAM) (not illustrated) as a work area while the CPU 209 controls each portion based on a control program stored in a read only memory (ROM) (not illustrated).

First, in step S01, the CPU 209 starts driving of a drive motor in an uncontrolled state in which the drive motor is not controlled by the correction value generating unit 300 and then, a rotating member is rotated in step S02.

Next, in step S03, the CPU 209 causes a velocity variation extraction calculating unit 301 to generate velocity variation data ΔV (FIG. 4B) that is obtained by subtracting a velocity instruction value Vref for rotating a drive shaft at a predetermined constant velocity from a velocity data Venc (FIG. 4A) detected by the encoder 204 (114). Then, in step S04, the CPU 209 accumulates velocity variation data ΔV as data 1 in the memory unit MR01. In step S05, the CPU 209 determines whether rotational variation data for one revolution of the rotating member has been accumulated. If the rotational variation data for one revolution of the rotating member has been accumulated (YES in step S05), the process proceeds to step S06. In step S06, the CPU 209 determines whether an absolute amount of a maximum velocity variation width ΔVmax of the velocity variation data ΔV is smaller than that of an allowable convergence range Vwide. If the absolute amount of the variation maximum width ΔVmax of the velocity variation data ΔV is equal to or greater than that of the allowable convergence range Vwide (NO in step S06), the process proceeds to step S07.

Figure 4A:
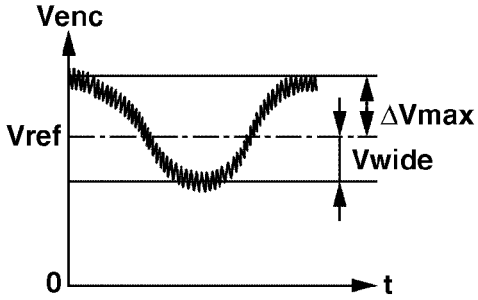
FIGS. 4A to 4G are views illustrating velocity variation data when generating a correction value according to an embodiment of the present invention.
Figure 4B:
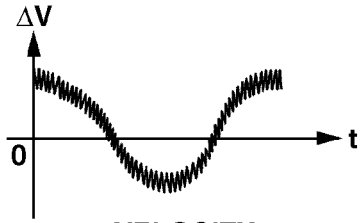
Figure 4C:
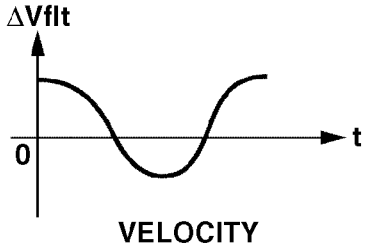
Figure 5:
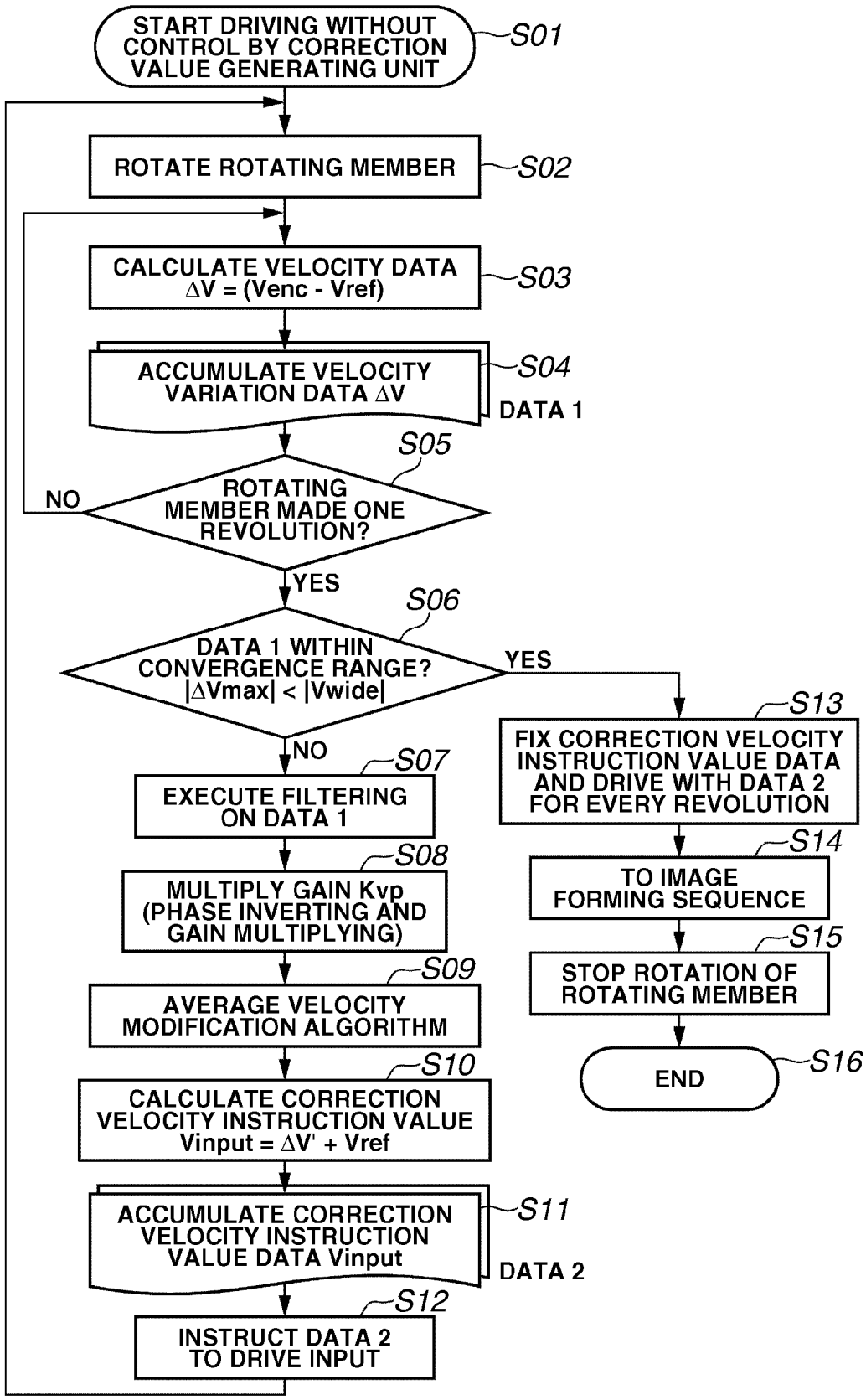
FIG. 5 is a flowchart illustrating a control process according to an embodiment of the present invention.

In step S07, the CPU 209 extracts a specific frequency by a filter calculating unit 302 from data 1 and obtains the filter calculated data ΔVflt (FIG. 4C). Here, filtering is performed in particular on velocity variation of a high frequency component other than a frequency of a rotational velocity variation to be canceled by velocity variation correction control.

Figure 4D:
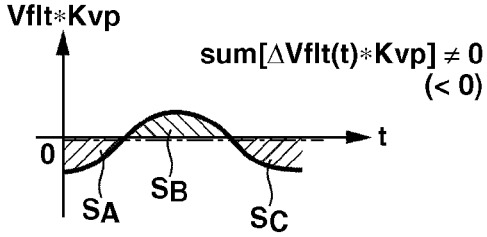

Next, in step S08, the CPU 209*a* causes cancellation gain adjusting unit 303 to multiply the filter calculated data ΔVtlt by a correction gain Kvp to obtain data ΔVflt*Kvp (FIG. 4D). The correction gain Kvp is set in the range of 0>Kvp≧−1, a phase is inverted and multiplied by a predetermined gain. Here, a correction profile of an inverted phase less than 100% relative to input velocity variation is created, so that a risk of mechanical breakdown is reduced. The mechanical breakdown appears when rapid torque variation occurs to a motor or, a motor or machine is subjected to a mechanical resonance. More specifically, in an embodiment, a gain value of −0.5 is set to the correction gain Kvp in which reduction of convergence stabilizing time for rotational unevenness correction control and the settings relative to the risk of resonance as described above are empirically found out.

Figure 4E:
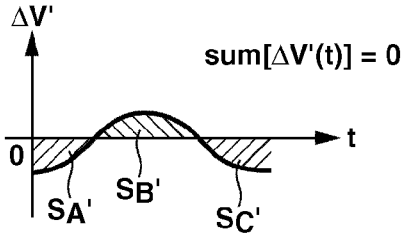

Next, in step S09, the CPU 209 performs absolute value modification ΔV' of a correction value in an average velocity modification portion 304 (refer to FIG. 4E). A detailed description will be given below. More specifically, since there occurs a case in which a sum of the correction values obtained by data ΔVflt*Kvp is not 0, the correction value is modified by absolute value modification ΔV' to obtain the sum of 0. If the sum of the correction values is not 0, the average velocity of the generated correction velocity instruction value in one revolution of the rotating member deviates from the targeted velocity instruction value after generating the correction velocity instruction value obtained by summing the correction value and the velocity instruction value. Accordingly, in a case of controlling the drive roller of a transfer belt, the deviation causes image magnification variation or color misregistration. In a case of controlling the photosensitive drum, the deviation causes color misregistration. The deviation of the average velocity of the correction velocity instruction value from the target velocity can be caused by a calculation error as described above. In addition, the average velocity also deviates in a case where one rotation of a rotational variation period of a roller for driving the photosensitive drum or the transfer belt does not match the phases of a rotational variation period of a drive unit and a driving force transmission unit at the upstream of a photosensitive drum or a transfer belt.

Figure 4F:
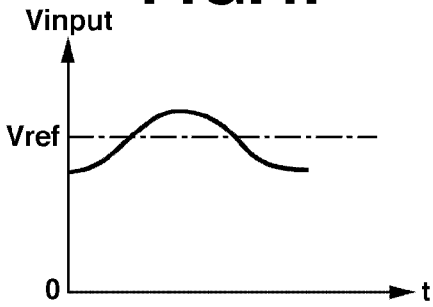

Next, in step S10, the CPU 209 generates a correction velocity instruction value Vinput by adding a velocity instruction value Vref to an absolute value modification ΔV' in a correction velocity instruction value generating unit 305 (FIG. 4F).

Figure 4G:
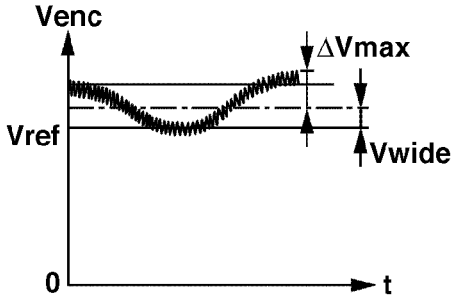

In step S11, the CPU 209 accumulates the generated correction velocity instruction value Vinput as data 2 in the memory MR02. A velocity detection result is shown in FIG. 4G, which is obtained when driving has been performed based on the correction velocity instruction value. In comparison with uncontrolled rotational variation of FIG. 4A, a velocity variation is reduced by a quantity multiplied by a correction gain, and beside that, an average velocity is obtained as Vref.

In step S12, the CPU 209 instructs a drive motor to perform control by a correction value generating unit 300 based on data 2. Again, in step S02, a rotating member is rotated while a drive motor is controlled by the correction value generating unit 300 based on data 2.

Next, similar to the above-described process, steps S03 to S05 are executed and, in step S06, the CPU 209 determines whether an absolute amount of a maximum velocity variation width ΔVmax of velocity variation data ΔV is smaller than that of an allowable convergence range Vwide.

If an absolute amount of the maximum velocity variation width ΔVmax of velocity variation data ΔV is smaller than that of the allowable convergence range Vwide (YES in step S06), the process proceeds to step S13.

In step S13, the CPU 209 determines a correction velocity instruction value and inputs to a drive the instruction values of the succeeding drive rotation by repeating the correction velocity instruction value for every revolution.

In step S14, the CPU 209 drives an image forming system in an image forming sequence or a warm-up sequence. In step S15, the CPU 209 stops rotation of a rotating member and terminates the process in step S16.

When an image forming system is driven by a sequence such as the image forming sequence or warm-up sequence, a correction velocity instruction value needs to be initially determined through the above described sequence of the rotational variation correction control, then the following relevant operations can be performed.

Figure 6:
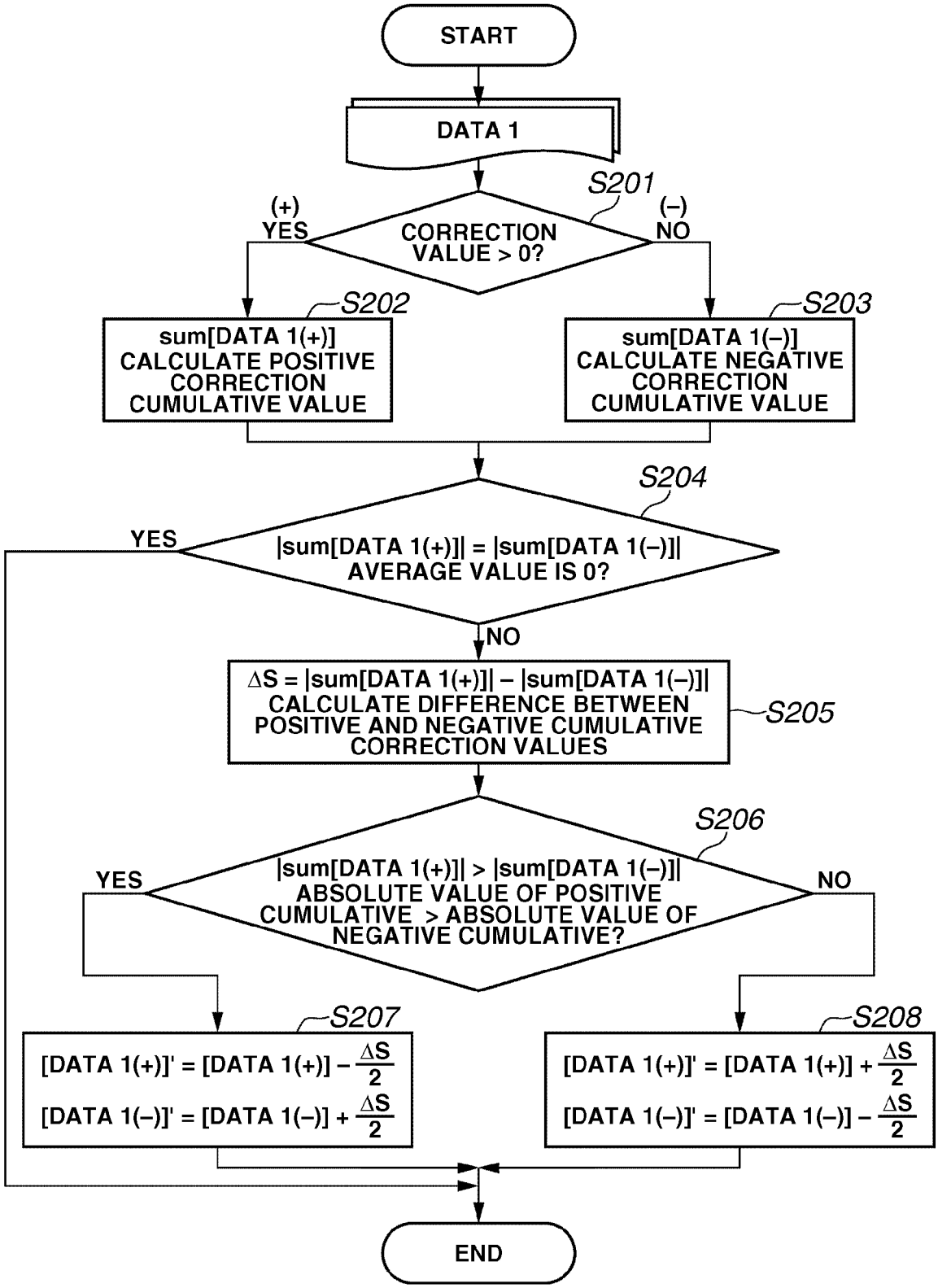
FIG. 6 is a flowchart illustrating an average velocity correction algorithm according to an embodiment of the present invention.
Figure 7A:
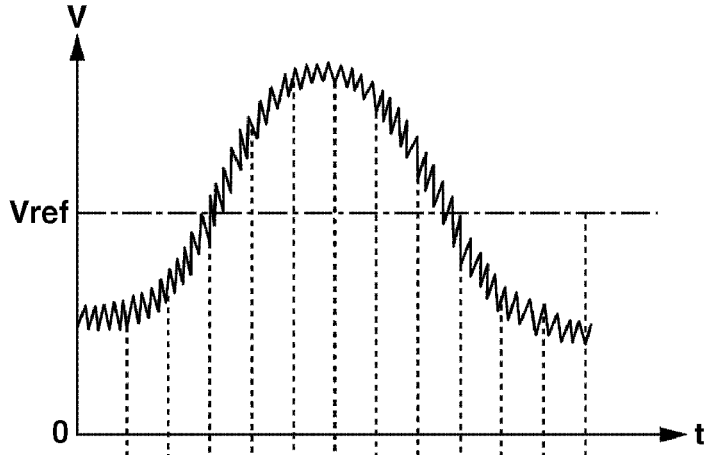
FIG.7A PRIOR ART
FIGS. 7A to 7C are views illustrating a conventional technique.
Figure 7B:
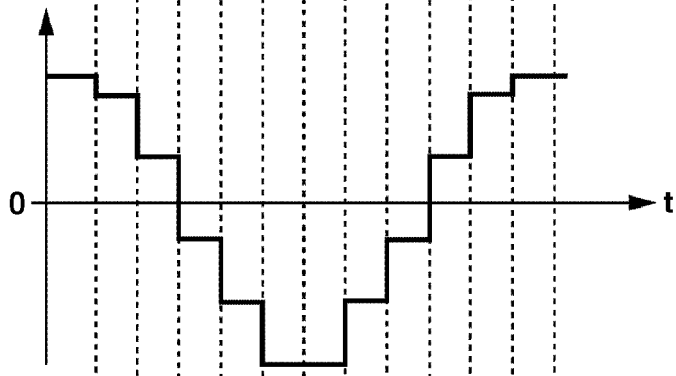
FIG.7B PRIOR ART
Figure 7C:
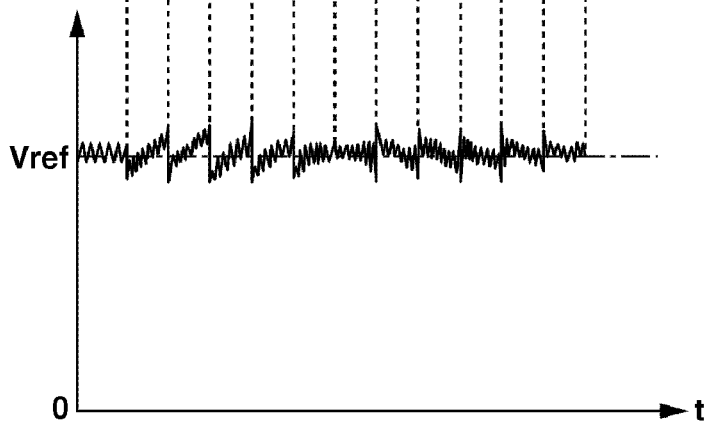
FIG.7C PRIOR ART

Next, with reference to a flowchart illustrated in FIG. 6, an average velocity modification algorithm that performs absolute value modification ΔV' of a correction value in an average value modification portion 304 as step S09 will be described.

In step S08 of FIG. 5, data for one revolution of a rotating member has been generated by multiplying a phase inverting operation of a correction value and a gain coefficient. Then, the CPU 209 first determines whether the correction value is positive or negative in step S201 in the flowchart of FIG. 6 that illustrates details of step S09. Next, in step S202, the CPU 209 performs cumulative calculation of positive data (SUM [data (+)]). In step S203, the CPU 209 performs cumulative calculation of negative data (SUM [data (−)]). In step S204, the CPU 209 determines whether an average value is 0 (SUM [data (+)] is equal to SUM [data (−)]) based on cumulative data SUM [data (+) and SUM [data (−)]]. In a case where the average value is 0 (YES in step S204), this average velocity modification algorithm is terminated. However, as described above, there is a case in which the average value is not 0. Therefore, a method for modifying correction value data will be described below.

In a case where the average correction value is not 0 (NO in step S204), the CPU 209 first calculates a differential value ΔS of the positive and negative cumulative data in step S205. Next, in step S206, the CPU 209 determines whether the positive or negative cumulative data has more absolute values. In a case where there exists more positive correction value cumulative data (YES in step S206), the CPU 209 specifies as data 1 (+)' the data of the positive correction value cumulative data from which an amount of ΔS/2 is subtracted, and specifies as data 1 (−) the data of the negative correction value cumulative data to which an amount of ΔS/2 is added, in step S207. That is, a sum of correction data becomes 0 by making equal acumulative amount of positive and negative correction data. Therefore, the instruction average velocity in one revolution of a rotating member does not vary. In a case where a large amount of negative correction value cumulative data exists (NO in step S206), the CPU 209 specifies as data 1 (+)' the data of the positive correction value cumulative data to which an amount of ΔS/2 is added, and specifies as data 1 (−) the data of the negative correction value cumulative data from which an amount of ΔS/2 is subtracted, in step S208. That is, a sum of correction data becomes 0 by making equal an accumulation amount of the positive and negative correction data, and the instruction average velocity in one revolution of the rotating member does not vary.

At this time, the result of subtraction from or addition to correction value data is arbitrarily distributed to each data to perform correction. A variety of patterns can be employed when the correction result is distributed. For example, the data can be equally distributed to all correction data. Alternatively, the data can be collected and distributed to only specific correction data. In any method, it is desirable that velocity variation of a rotating member does not become worse according to types of the distributing methods. However, even if the variety of distributing patterns is configured according to other embodiments of the present invention, it is possible to achieve almost equal effects as the present embodiment.

As described above, velocity variation of a rotating member can be suppressed by performing correction control of velocity variation of the rotating member at the time of driving the rotating member. Accordingly, the average velocity in one revolution of the rotating member can be a predetermined average velocity also with respect to an instruction value obtained by adding correction to a drive. Thus, it is possible to obtain an image forming apparatus capable of producing a good quality output image with good printing precision without the color misregistration or image unevenness in the sub-scanning direction.

The present invention is not limited to the present embodiment in which revolution control is performed each time that drive of the revolving member is started. A similar effect can also be obtained when a control algorithm similar to that of the present embodiment is activated only in a case where the configuration of mechanical parts has been determined and a correction value pattern of velocity variation is generated.

In addition, in a case where the image forming apparatus does not perform an image forming sequence, a similar effect can be obtained, for example, when a similar control algorithm is activated at the time of warm-up or at the time of down sequence immediately after startup, and a correction value pattern of velocity variation is generated.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-354432 filed Dec. 28, 2006, which is hereby incorporated by reference herein in its entirety.

What is claimed is:

1. An image forming apparatus comprising:

a rotating member;

a driving force transmission unit configured to transmit drive force to the rotating member;

a drive unit configured to rotationally drive the rotating member via the driving force transmission unit;

a detecting unit configured to detect a velocity of the rotating member and generate velocity data based on the detected velocity; and a control unit configured to control the drive unit based on the velocity data by inputting a drive velocity instruction value to the drive unit, wherein the control unit calculates velocity variation data by subtracting the drive velocity instruction value from the velocity data detected by the detecting unit, wherein the control unit obtains filter calculated data by filtering the velocity variation data, wherein the control unit calculates a correction value to be added to the drive velocity instruction value so as to cancel the filter calculated data during one rotation of the rotating member, wherein the control unit calculates modification data so that a sum of the correction value is 0, and wherein the control unit controls the drive unit based on a correction drive instruction value calculated by adding the drive velocity instruction value to the modification data.

2. The image forming apparatus according to claim 1, wherein driving force transmission unit comprises a motor, and a drive signal for driving the motor is generated based on the correction value and the drive velocity instruction value.

3. The image forming apparatus according to claim 1, wherein the rotating member is a drive roller that drives a photosensitive drum.

4. The image forming apparatus according to claim 3, wherein the detecting unit includes a photosensitive member drive shaft angular velocity detecting unit configured to detect an angular velocity of a photosensitive member drive shaft for driving the photosensitive drum.

5. The image forming apparatus according to claim 1, wherein the rotating member is a drive roller that drives a transfer belt.

6. The image forming apparatus according to claim 5, wherein the detecting unit includes a drive roller angular velocity detecting unit configured to detect an angular velocity of a shaft of the drive roller that transports the transfer belt.

7. The image forming apparatus according to claim 1, wherein the image forming apparatus is a tandem type image forming apparatus comprising a plurality of image forming units including the photosensitive drum for each color and a transfer belt for superimposing a plurality of color toner images onto each other.

8. The image forming apparatus according to claim 1, further comprising a moving average calculating unit configured to perform moving average calculation with respect to velocity data generated by the detecting unit.

9. A method for controlling a velocity variation of a rotating member of an image forming apparatus, the method comprising:

rotationally driving the rotating member based on a drive velocity instruction value;

detecting a velocity of the rotating member and generating velocity data based on the detected velocity;

inputting a drive velocity instruction value;

calculating velocity variation data by subtracting the drive velocity instruction value from the velocity data;

obtaining filter calculated data by filtering the velocity variation data;

calculating a correction value to be added to the drive velocity instruction value so as to cancel the filter calculated data during one rotation of the rotating member;

calculating modification data so that a sum of the correction value is 0; and controlling the step of rotationally driving the rotating member based on a correction drive instruction value calculated by adding the drive velocity instruction value to the modification data.

10. The method according to claim 9, wherein the rotating member is a drive roller that drives a photosensitive drum of the image forming apparatus.

11. The method according to claim 9, wherein the rotating member is a drive roller that drives a transfer belt of the image forming apparatus.

* * * * *